US007995942B2

(12) United States Patent
Tonohiro et al.

(10) Patent No.: US 7,995,942 B2
(45) Date of Patent: Aug. 9, 2011

(54) DEVELOPING APPARATUS OF IMAGE FORMING APPARATUS AND SUPPLYING METHOD OF TONER

(75) Inventors: Chie Tonohiro, Shizuoka (JP); Hiromichi Mitamura, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 100 days.

(21) Appl. No.: 12/401,673

(22) Filed: Mar. 11, 2009

(65) Prior Publication Data

US 2009/0232531 A1 Sep. 17, 2009

Related U.S. Application Data

(60) Provisional application No. 61/036,572, filed on Mar. 14, 2008.

(51) Int. Cl.
*G03G 15/08* (2006.01)

(52) U.S. Cl. ..... 399/53; 399/27; 399/45; 399/82; 399/258

(58) Field of Classification Search ..... 399/53, 399/27, 82, 254, 258, 45, 30
See application file for complete search history.

(56) References Cited

U.S. PATENT DOCUMENTS

| | | | | |
|---|---|---|---|---|
| 7,630,656 | B2 * | 12/2009 | Endou et al. | 399/27 X |
| 2001/0050706 | A1 * | 12/2001 | Ishii | 399/27 X |
| 2002/0076226 | A1 * | 6/2002 | Ishimizu et al. | 399/45 |
| 2007/0177906 | A1 * | 8/2007 | Yamanaka et al. | 399/279 |

FOREIGN PATENT DOCUMENTS

| | | | |
|---|---|---|---|
| JP | 02-181772 | A * | 7/1990 |
| JP | 03-155577 | A * | 7/1991 |
| JP | 2002-296905 | | 10/2002 |
| JP | 2005-024822 | | 1/2005 |
| JP | 2006-154193 | | 6/2006 |

OTHER PUBLICATIONS

Machine translation of JP 2002-296905 A dated Aug. 6, 2010.*

* cited by examiner

*Primary Examiner* — Sophia S Chen
(74) *Attorney, Agent, or Firm* — Turocy & Watson, LLP

(57) ABSTRACT

A developing unit that includes a stirring roller stirring a developer and a developing roller and develops an electrostatic latent image formed on an image carrier to form a toner image; a drive source that rotationally drives the developing roller and the stirring roller; and a control unit that switches a rotational speed of the developing roller in modes of an image formation mode and an adjustment mode, and rotationally controls the stirring roller at a first speed in the modes are provided.

20 Claims, 6 Drawing Sheets

DEVELOPING APPARATUS OF IMAGE FORMING APPARATUS AND SUPPLYING METHOD OF TONER

CROSS-REFERENCE TO RELATED APPLICATION

This application is based upon and claims the priority of U.S. Provisional Application No. 61/036,572, filed on Mar. 14, 2008, the entire contents of which are incorporated herein by reference.

TECHNICAL FIELD

The present invention relates to an image forming apparatus of electrophotographic recording system obtaining a color image by superimposing toner of plural colors, and specifically to a developing apparatus and a supplying method of toner.

BACKGROUND

Generally, in an image forming apparatus of electrophotographic recording system, photoconductive drums are arranged in a line and electrostatic latent images are formed by applying laser beams to the respective photoconductive drums. The photoconductive drums form toner images of respective colors with developing apparatuses and a color image is obtained by multiply-transferring the toner images of respective colors on a sheet of paper.

The developing apparatuses are provided for the respective photoconductive drums, toner cartridges are provided for supplying toner to the developing apparatuses, and the toners contained in the toner cartridges are carried to the developing apparatuses.

The developing apparatus has a developing roller for moving the toner to the photoconductive drum and a mixer for stirring a developer. Within the mixer, a stirring roller that stirs the toner and carrier is provided, and the developing roller and the stirring roller are simultaneously operated using the same drive source (motor).

In the image forming apparatus, printing processing is performed at some process speeds. Assuming that printing on paper having a normal thickness is processed at the normal speed, for example, printing on thick paper or special paper is processed at a reduced process speed to ½ speed, ⅓ speed, or the like.

For the electrophotographic recording system having some process speeds, if the developing roller and the stirring roller are driven by the same drive source and the rotational ratio between the developing roller and the stirring roller is constant, the following defects are caused.

The image forming apparatus has some operation modes, for example, modes for executing a printing job at the normal speed, a printing job at the ½ speed, and a printing job at the ⅓ speed. However, if the developing roller and the stirring roller rotate at the same rotational ratio, when the printing job at the ½ speed and the printing job at the ⅓ speed are executed, the rotational speed of the developing roller becomes lower, the stirring roller also rotates at the lower speed, and thereby, stirring of toner becomes insufficient. Accordingly, the next printing is started with the insufficient charge and the inhomogeneous concentration ratio of toner to carrier, and causes density irregularities in image.

Further, the apparatus also has a forcible toner supply mode and an automatic toner adjustment mode other than the modes of executing printing jobs at the ½ and ⅓ speeds. The forcible toner supply mode is a mode of supplying and stirring toner when the toner concentration becomes lower to less than a predetermined level. The automatic toner adjustment mode is a mode of automatically stirring toner and carrier to adjust the toner concentration when the power is on.

It is unnecessary to rotate the developing roller in the forcible toner supply mode and the automatic toner adjustment mode because printing on paper is not performed, however, the developing roller is arranged to rotate following the stirring roller and the developing roller idly rotates.

Japanese Patent No. 3774123 discloses an image forming apparatus in which a developing roller and a stirring roller are independently driven and, when the power is on, the developing roller is stopped and only the stirring roller is driven.

Further, JP-A-2006-154193 discloses a developing apparatus in which a developing roller and a stirring roller are independently driven and their numbers of rotations are switchable.

Furthermore, JP-A-2005-24822 discloses an image forming apparatus in which numbers of rotations of a developing roller and a stirring roller are individually controllable.

However, the conventional image forming apparatus is not able to control the rotations of the developing roller and the stirring roller according to some process speeds, and the developing roller idly rotates, and the toner may fly and the developer may be degraded. Further, defects such that the stirring by the stirring roller is insufficient are caused.

SUMMARY

According to an aspect of the present invention, there is provided an image forming apparatus, comprising:

an image carrier;

an exposure unit that exposes a surface of the image carrier to light and forms an electrostatic latent image;

a developing unit that includes a stirring roller stirring a developer and a developing roller moving toner to the surface of the image carrier, and develops the electrostatic latent image formed on the image carrier to form a toner image;

a drive source that rotationally drives the developing roller and the stirring roller; and a control unit that controls the drive source to switch a rotational speed of the developing roller in modes of an image formation mode and an adjustment mode of the image forming apparatus, respectively, and rotationally controls the stirring roller at a first speed in the modes.

DETAILED DESCRIPTION

Throughout this description, the embodiment and example shown should be considered exemplars, rather than limitations on the apparatus of the present invention.

Hereinafter, an embodiment of an image forming apparatus will be described in detail with reference to the drawings. In the respective drawings, the same signs are assigned to the same parts.

Figure 1:
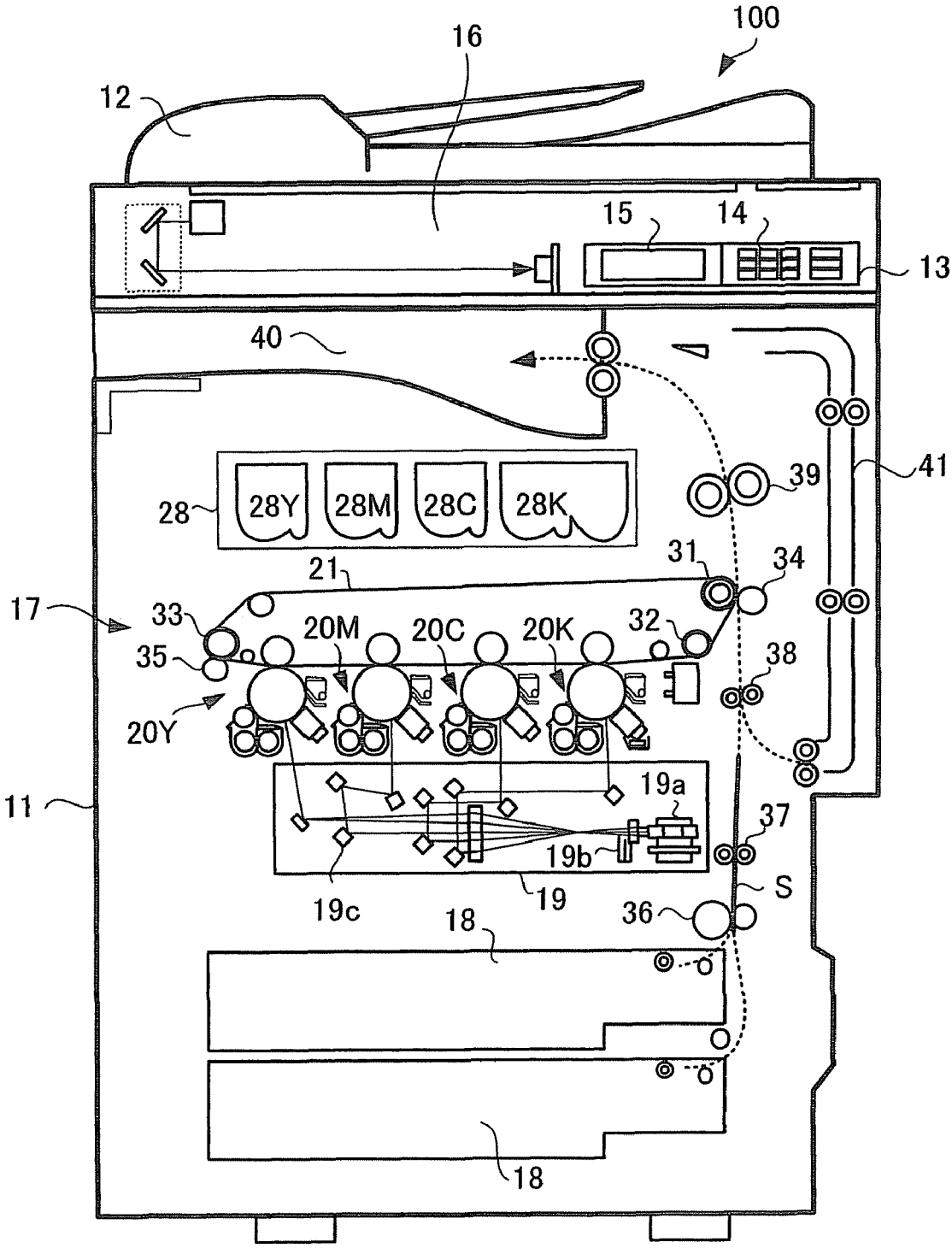
FIG. 1 is a front view showing one embodiment of an image forming apparatus.

FIG. 1 is a front view showing one embodiment of an image forming apparatus. In FIG. 1, 100 denotes an image forming apparatus, for example, MFP (Multi-Function Peripherals), printer, copier, or the like. In the following description, an MFP will be explained as an example.

There is a document table (not shown) in an upper part of a main body 11 of the MFP 100, and an automatic document feeder (ADF) 12 is openably provided on the document table. Further, an operation panel 13 is provided on the main body 11. The operation panel 13 has an operation part 14 including various kinds of keys and a touch-screen display part 15.

A scanner section 16 is provided under the ADF 12 within the main body 11. The scanner section 16 reads a document fed by the ADF 12 or document placed on the document table and generates image data. Further, The MFP has a printer section 17 at the center within the main body 11 and some cassettes 18 containing sheets of paper in various sizes in the lower part of the main body 11.

The printer section 17 includes photoconductive drums, lasers, etc. and processes image data read by the scanner section 16 and image data created by a PC (personal computer) and forms an image on paper (the detailed description will be later).

The paper on which an image is formed by the printer section 17 is ejected to an eject part 40. The printer section 17 is a tandem color laser printer, for example, and scans the photoconductive drums with laser beams from a laser exposure unit 19 and generates images.

The printer section 17 includes image forming parts 20Y, 20M, 20C, 20K of the respective colors of yellow (Y), magenta (M), cyan (C), black (K). The image forming parts 20Y, 20M, 20C, 20K are arranged in a line along the upstream to the downstream under an intermediate transfer belt 21.

Figure 2:
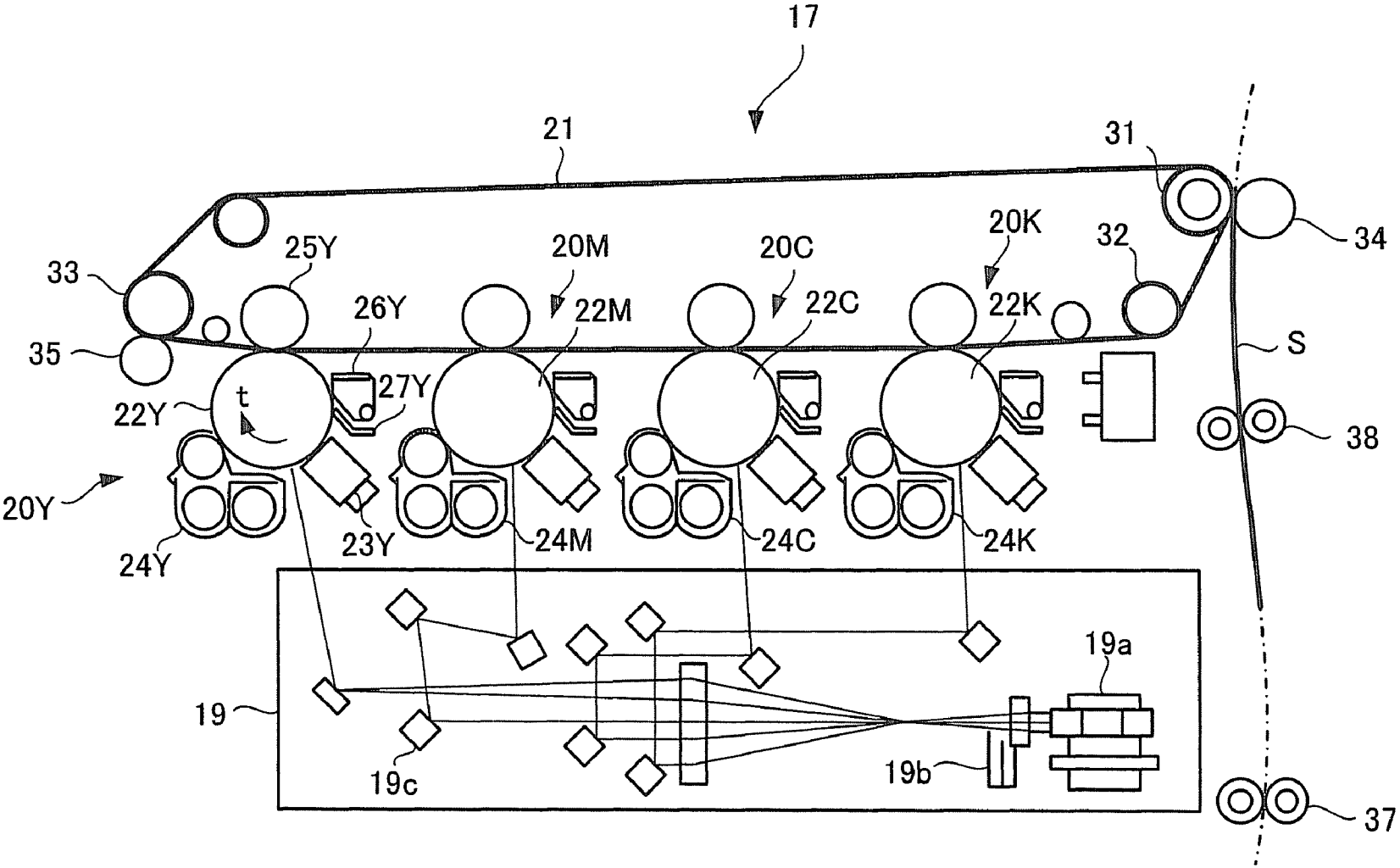
FIG. 2 is a configuration diagram showing an internal structure of the image forming apparatus in FIG. 1.

The printer section 17 including the image forming parts 20Y, 20M, 20C, 20K is enlarged and shown in FIG. 2. In the following description, the image forming part 20Y will be described as a representative because the respective image forming parts 20Y, 20M, 20C, 20K have the same configuration.

As seen from FIG. 2, the image forming part 20Y has a photoconductive drum 22Y as an image carrier, and a charging charger 23Y, a developing unit 24Y, a primary transfer roller 25Y, a cleaner 26Y, a blade 27Y, etc. are provided along a rotational direction t around the photoconductive drum 22Y. A yellow laser beam is applied from the laser exposure unit 19 to an exposure position of the photoconductive drum 22Y to form an electrostatic latent image on the photoconductive drum 22Y.

The charging charger 23Y of the image forming part 20Y uniformly charges the entire surface of the photoconductive drum 22Y. The developing unit 24Y supplies a two-component developer including yellow toner and carrier to the photoconductive drum 22Y with a developing roller to which a developing bias is applied. The cleaner 26Y removes the residual toner on the surface of the photoconductive drum 22Y using the blade 27Y.

A toner cartridge 28 (FIG. 1) that supplies toner to the developing units 24Y, 24M, 24C, 24K is provided above the image forming parts 20Y, 20M, 20C, 20K. In the toner cartridge 28, toner cartridges 28Y, 28M, 28C, 28K of the respective colors of yellow (Y), magenta (M), cyan (C), and black (K) are adjacently provided.

The intermediate transfer belt 21 cyclically moves and, for example, semiconductor polyimide is used therefor in view of heat resistance and abrasion resistance. The intermediate transfer belt 21 is hung around a drive roller 31 and driven rollers 32, 33, and the intermediate transfer belt 21 faces in contact with the photoconductive drums 22Y to 22K. A primary transfer voltage is applied to the position of the intermediate transfer belt 21 facing the photoconductor drum 22Y by the primary transfer roller 25Y and primary transfers the toner image on the photoconductive drum 22Y onto the intermediate transfer belt 21.

A secondary transfer roller 34 is provided facing the drive roller 31 tensioning the intermediate transfer belt 21. When a sheet of paper S passes between the drive roller 31 and the secondary transfer roller 34, a secondary transfer voltage is applied by the secondary transfer roller 34 and the toner image on the intermediate transfer belt 21 is secondarily transferred onto the sheet S. A belt cleaner 35 is provided near the driven roller 33 of the intermediate transfer belt 21.

On the other hand, the laser exposure unit 19 includes a polygon mirror 19*a*, an imaging lens system 19*b*, a mirror 19*c*, etc., and scans a laser beam output from a semiconductor laser device in an axis direction of the photoconductive drum 22.

Further, as shown in FIG. 1, a separating roller 36 that takes out a sheet of paper S within the paper feed cassette 18, and transport roller 37 and a resist roller 38 are provided between the paper feed cassette 18 and the secondary transfer roller 34, and a fixing device 39 is provided at the downstream of the secondary transfer roller 34.

The paper eject part 40 and a reverse transport path 41 are provided at the downstream of the fixing device 39. In the paper eject part 40, the sheet from the fixing device 39 is ejected. The reverse transport path 41 reverses the sheet S and guides it toward the secondary transfer roller 34 for use in two-sided printing.

Next, the operation of the image forming apparatus 100 in FIG. 1 and FIG. 2 will be explained. When image data is input from the scanner 16, PC, or the like, images are sequentially formed in the respective image forming parts 20Y to 20K.

The image forming part 20Y is explained as an example. A laser beam corresponding to yellow (Y) image data is applied to the photoconductive drum 22Y, and an electrostatic latent image is formed thereon. Further, the electrostatic latent image on the photoconductive drum 22Y is developed by the developing unit 24Y and a yellow (Y) toner image is formed.

The photoconductive drum 22Y contacts the rotating intermediate transfer belt 21 and primarily transfers the yellow (Y) toner image onto the intermediate transfer belt 21 with the primary transfer roller 25Y. After the primary transfer of the toner image onto the intermediate transfer belt 21, the residual toner is removed by the cleaner 26Y and the blade 27Y, and the photoconductive drum 22Y becomes available for the next image formation.

In the same manner as in the formation process of the yellow (Y) toner image, toner images of magenta (M), cyan (C), black (K) are formed by the image forming parts 20M to 20K, and the respective toner images are sequentially transferred onto the same position as that of the yellow (Y) toner image on the intermediate transfer belt 21, the toner images of yellow (Y), magenta (M), cyan (C), black (K) are multiply-transferred onto the intermediate transfer belt 21, and thereby, a full-color toner image is obtained.

The intermediate transfer belt 21 secondarily transfers the full-color toner image in one operation onto the sheet S with a transfer bias of the secondary transfer roller 34. In synchronization with the full-color toner image on the intermediate transfer belt 21 reaching the secondary transfer roller 34, the sheet S is fed from the paper feed cassette 18 to the secondary transfer roller 34.

The sheet S with the toner image secondarily transferred thereon reaches the fixing device 39 for fixing the toner image. The sheet S with the toner image fixed thereon is ejected to the paper eject part 40. On the other hand, the residual toner on the intermediate transfer belt 21 is cleaned by the belt cleaner 35 after secondary transfer.

Next, details of a developing apparatus 50 will be described with reference to FIG. 3. The developing apparatus 50 includes the developing units 24Y, 24M, 24C, 24K, and the signs Y, M, C, K are omitted in the description as below because the respective developing units have the same configuration.

Figure 3:
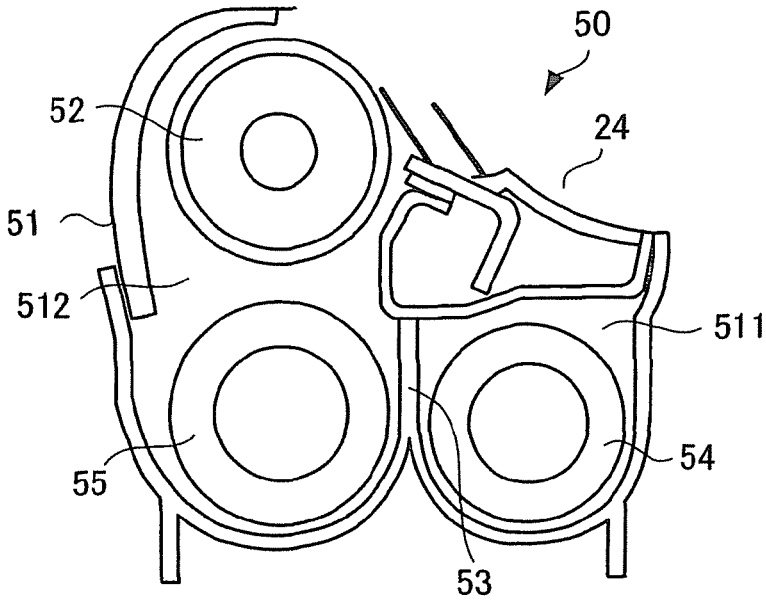
FIG. 3 is a front view showing a configuration of a developing apparatus within the image forming apparatus.

FIG. 3 is a front view of the developing apparatus 50. 24 denotes the developing unit including a developing container 51. The developing container 51 is provided nearly in parallel along the axis direction of the photoconductive drum 22, and a developing roller 52 is rotatably provided within the developing container 51.

The developing roller 52 has a magnet inside and is also called a magnet roller, and faces the photoconductive drum 22. The developing roller 52 carries carrier and toner on the surface thereof, and supplies the toner to the photoconductive drum 22 by rotation.

The developing container 51 is partitioned into two spaces 511, 512 by a partitioning plate 53, and a two-component developer, i.e., toner and carrier are supplied to one space 511. The structure for supply is omitted.

A stirring roller 54 forming a first mixer is provided in the one space 511 of the developing container 51, and a stirring roller 55 forming a second mixer is provided in the other space 512. The stirring roller 54 and the stirring roller 55 respectively stir the developer (toner and carrier) within the developing container 51 and supply it to the developing roller 52 and circulate the developer within the space 511 and the space 512. Regarding the direction in which the developer is carried within the developing container 51, the developer is circulated to be carried from the front side to the rear side of the space 512 in FIG. 3 and transported from the rear side to toward the front side of the space 511.

A toner concentration sensor 56 (FIG. 5) is provided within the space 511, and the sensor detects toner concentration of the developer stirred and carried by the stirring roller 54. If the toner concentration detected by the toner concentration sensor 56 is less than a preset value, toner is supplied.

Figure 4:
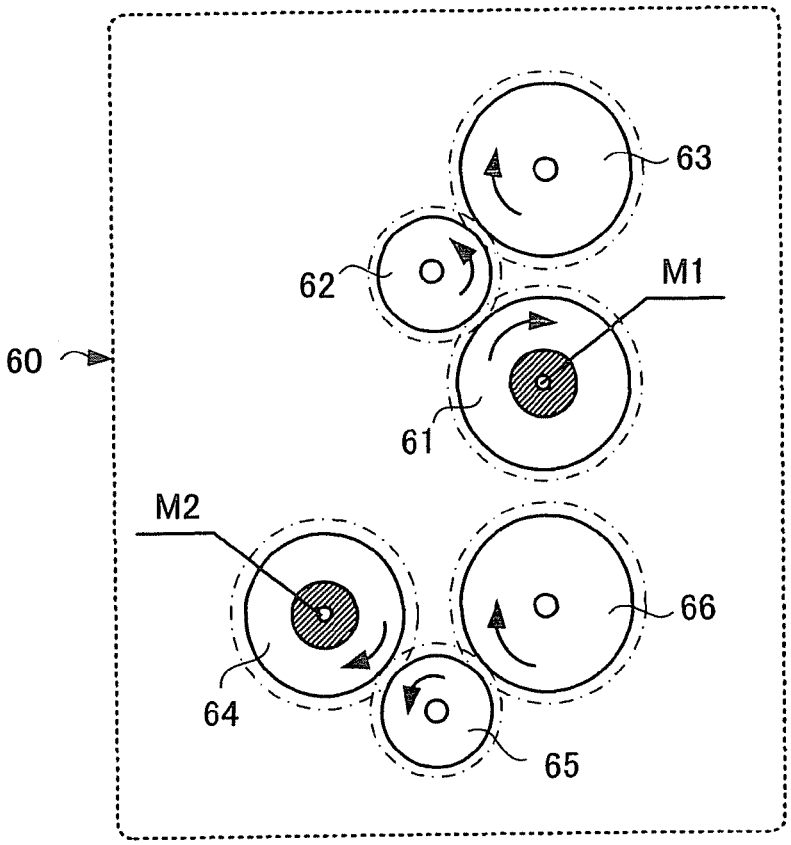
FIG. 4 is a rear view showing one example of a drive mechanism for a developing roller and stirring rollers of the developing apparatus.

FIG. 4 shows a drive mechanism 60 of the developing roller 52 and the stirring rollers 54, 55. Although FIG. 3 is the front view of the developing apparatus 50, the drive mechanism 60 is provided at the rear side of the developing apparatus 50.

In FIG. 4, the drive mechanism 60 is independently provided with a motor M1 that drives the developing roller 52 and a motor M2 that drives the stirring rollers 54, 55.

The mechanism has a gear 61 attached to the rotational shaft of the motor M1 and further has a gear 62 that meshes with the gear 61 and rotates and a gear 63 that meshes with the gear 62 and rotates. The developing roller 52 is rotated by the rotation of the gear 63.

Further, the mechanism has a gear 64 attached to the rotational shaft of the motor M2 and further has a gear 65 that meshes with the gear 64 and rotates and a gear 66 that meshes with the gear 65 and rotates. The stirring roller 54 rotates by the rotation of the gear 64, and the stirring roller 55 is rotated by the rotation of the gear 66.

The motor M1 rotationally driving the developing roller 52 is controlled in the number of rotations according to the image formation mode of the image forming apparatus 100, and rotates at the normal speed, the ½ speed, and the ⅓ speed. Further, the motor stops rotation in the adjustment modes of the image forming apparatus 100, i.e., in a toner concentration correction mode as in a forcible toner supply mode and an automatic toner adjustment mode. On the other hand, the motor M2 rotationally driving the stirring rollers 54, 55 rotates at the normal speed in the image formation mode and the adjustment mode.

Figure 5:
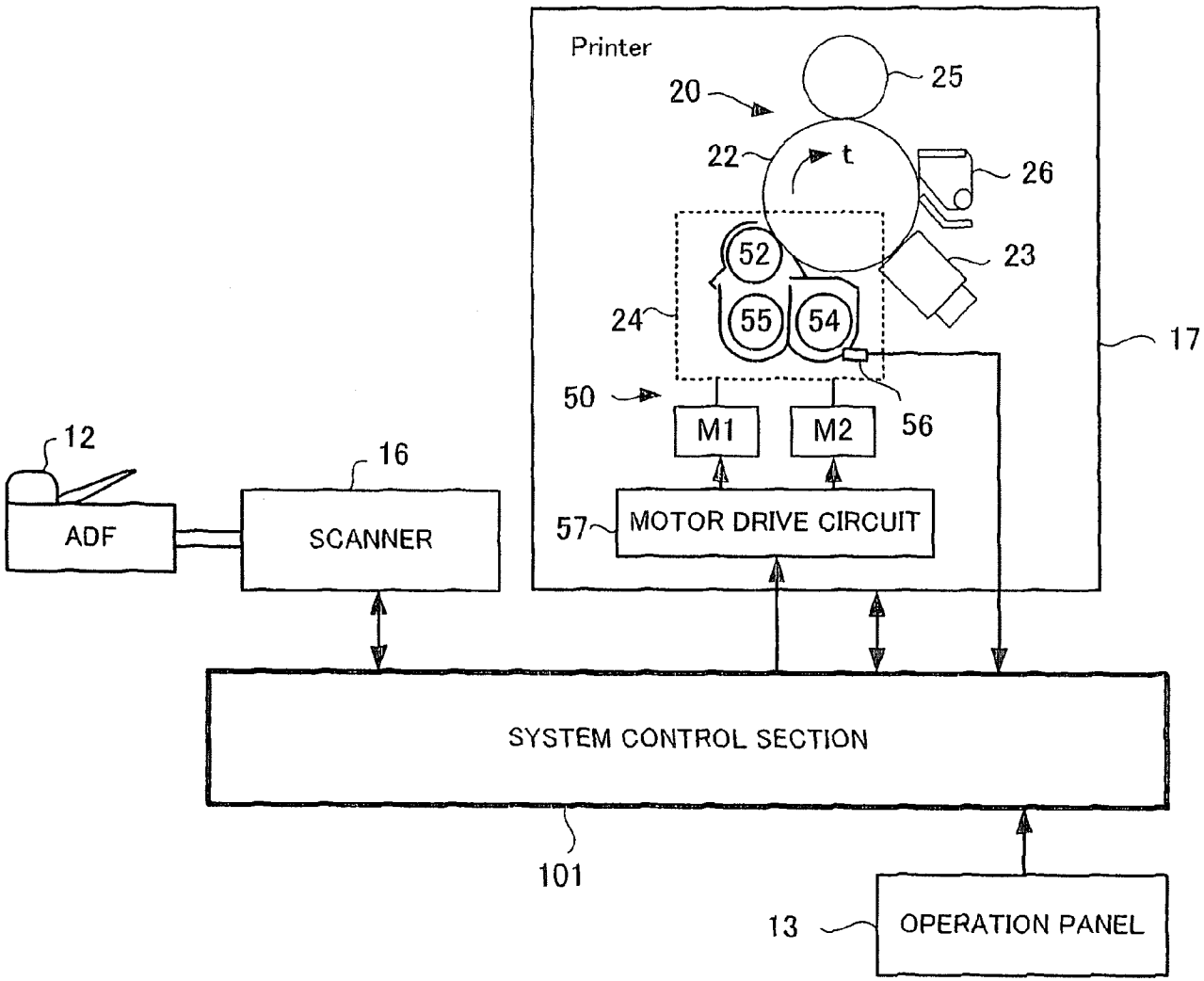
FIG. 5 is block diagram showing a control system of the image forming apparatus.

FIG. 5 is a block diagram showing a control system of the image forming apparatus 100, mainly showing a control system of the developing apparatus 50.

In FIG. 5, 101 denotes a system control section including CPU, RAM, ROM, etc., and controls the entire operation of the image forming apparatus 100. To the system control section 101, the operation panel 13, the scanner section 16, and the printer section 17 are respectively connected.

The image forming part 20 of the printer section 17 includes the photoconductive drum 22 as an image carrier, and the charging charger 23, the developing unit 24, the primary transfer roller 25, the cleaner 26, etc. are provided around the photoconductive drum 22.

The motor M1 driving the developing roller 52 and the motor M2 driving the stirring rollers 54, 55 of the developing unit 24 are controlled by a motor drive circuit 57, and the motor drive circuit 57 is controlled by the system control section 101.

The toner concentration sensor 56 is provided in the developing unit 24, and the toner concentration sensor 56 detects the toner concentration of the developer stirred and carried by the stirring roller 54 and supplies a detection result to the system control section 101.

The number of sets, paper size, paper thickness, and the like can be input from the operation panel 13, and the system control section 101 orders the operation mode of the image forming apparatus 100 according to the paper thickness and the like, and controls the process speed. For example, assuming that printing on paper having a normal thickness is processed at the normal speed, the printing on thick paper or special paper is processed at a reduced process speed to ½ speed, ⅓ speed, or the like. As the paper thickness is larger, transfer and fixing of the toner image on the paper becomes more difficult, and the process speed is necessary to be lower.

Figure 6A:
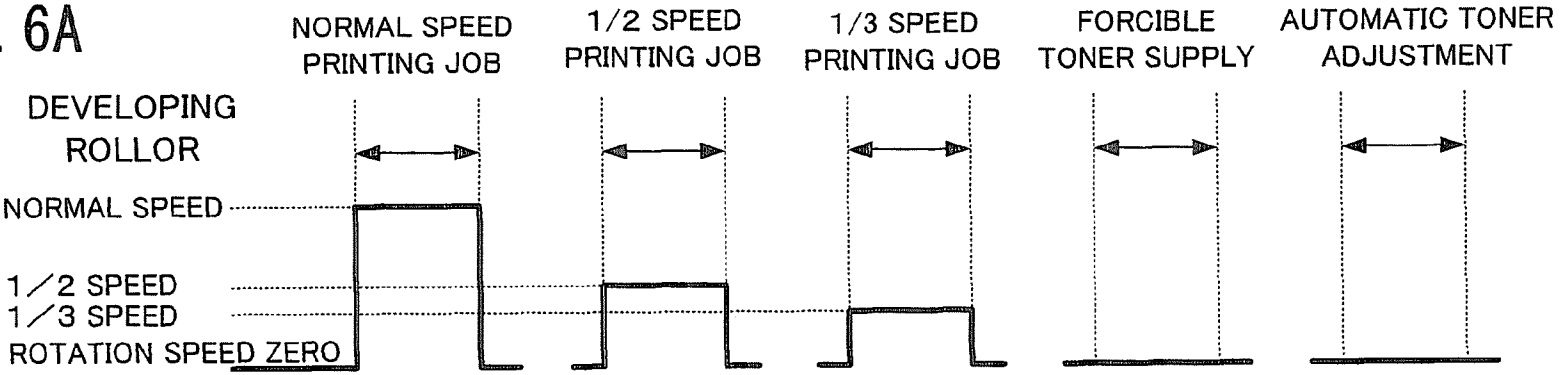
FIGS. 6A and 6B are waveform charts for explanation of driving of the developing roller and the stirring rollers.
Figure 6B:
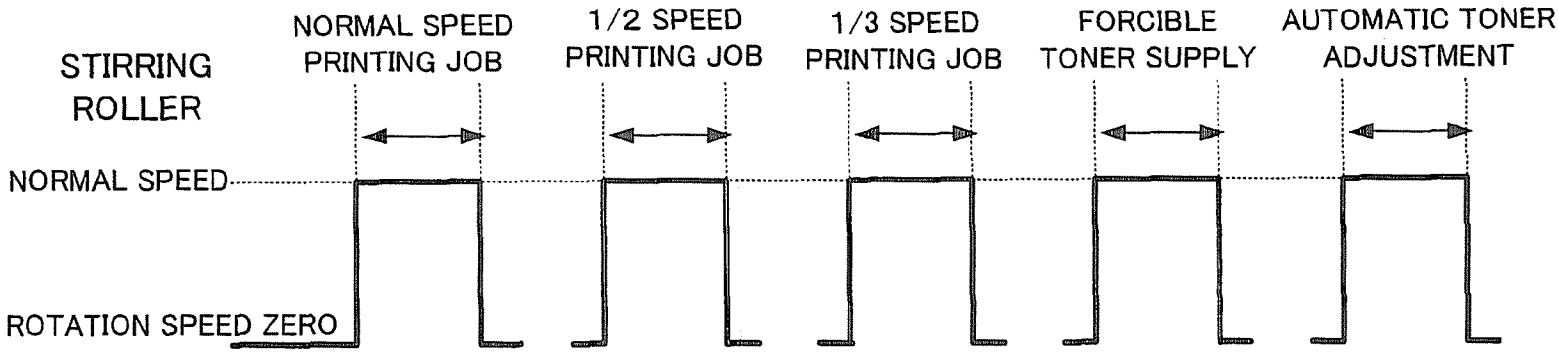

FIGS. 6A and 6B are diagrams for explanation of the operation of the developing apparatus 50 showing drive waveforms of the developing roller 52 and the stirring rollers 54, 55. FIG. 6A shows an operation of the developing roller 52, and FIG. 6B shows an operation of the stirring rollers 54, 55.

In the lateral axis direction of FIGS. 6A and 6B, the respective development modes (printing job at the normal speed, printing job at the ½ speed, printing job at the ⅓ speed), adjustment modes (forcible toner supply mode, automatic toner adjustment mode) are indicated. The forcible toner supply mode and the automatic toner adjustment mode are the toner concentration correction mode.

In the normal speed mode, all of the developing roller 52 and the stirring rollers 54, 55 rotate at the normal speed and stir the developer and supply the toner to the photoconductive drum 22.

Further, when printing jobs are executed at the ½ speed and the ⅓ speed, the rotational speeds of the developing roller 52 are reduced to ½ and ⅓, respectively. Simultaneously, the stirring rollers 54, 55 rotate at the normal speed. Accordingly, toner can be sufficiently stirred.

In the forcible toner supply mode and the automatic toner adjustment mode, the developing roller 52 stops rotating and the stirring rollers 54, 55 rotate at the normal speed.

The forcible toner supply mode is a mode of supplying and stirring toner when the toner concentration detected by the toner concentration sensor 56 is less than a predetermined level, and the developing roller 52 stops rotating because there is no printing operation. Further, toner can be sufficiently stirred by the rotation of the stirring rollers 54, 55.

The automatic toner adjustment mode is a mode of adjusting the toner concentration by automatically stirring toner and carrier when the power is on, and the developing roller 52 stops rotating because there is no printing operation. Further, toner can be sufficiently stirred by the rotation of the stirring rollers 54, 55.

Therefore, toner can be prevented from flying and toner can be reduced because the developing roller 52 stops when there is no need of rotation. Further, the photoconductive drum 22 that rotates concurrently with the developing roller 52 also stops rotating and the degradation of the photoconductor can be suppressed.

Figure 7:
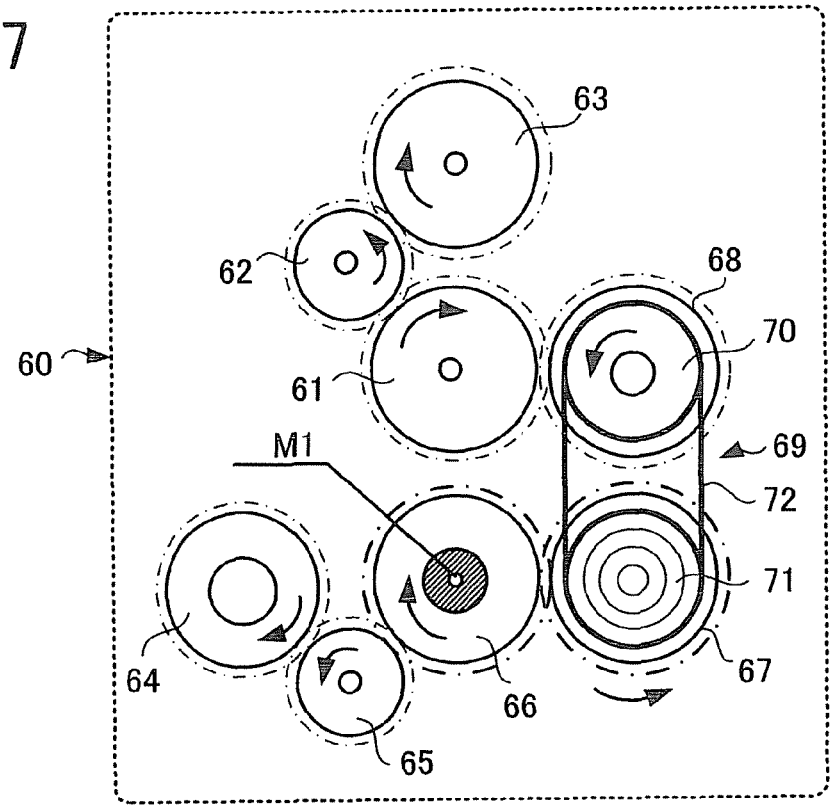
FIG. 7 is a rear view showing another example of the drive mechanism for the developing roller and the stirring roller of the developing apparatus.

FIG. 7 shows another embodiment of the drive mechanism 60. In the example in FIG. 7, the developing roller 52 and the stirring rollers 54, 55 are driven by a single drive source (motor 1). Further, a clutch 69 is provided for switching the number of rotations of the developing roller 52 according to the mode.

That is, in FIG. 7, the drive mechanism 60 includes one motor M1, the gear 66 is attached to the rotational shaft of the motor M1, and further, the gear 65 and the gear 64 are rotated by the rotation of the gear 66. In this example, the stirring roller 55 is rotated by the rotation of the gear 66, and the stirring roller 54 is rotated by the rotation of the gear 64.

The gear 66 meshes with a gear 67, and the gear 61 meshes with a gear 68. Further, in order to change and transmit the rotation of the gear 67 to the gear 68, the clutch 69 is provided. The clutch 69 has a gear 70 rotating with the gear 68 and a multi-stage gear 71 rotating with the gear 67, and a belt 72 is hung between the gear 70 and the multi-stage gear 71.

Figure 8A:
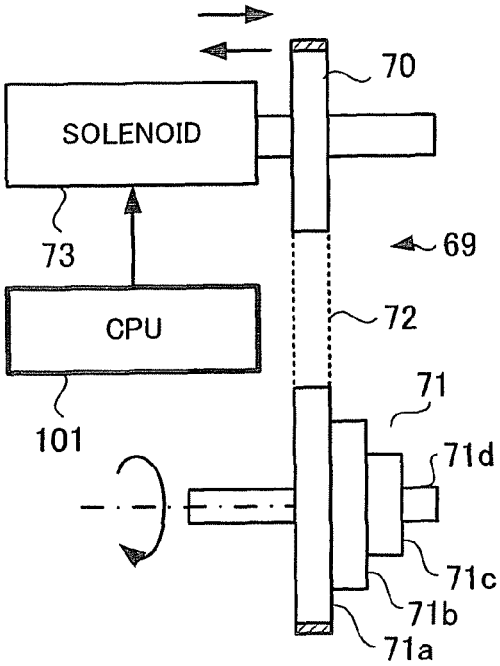
FIGS. 8A and 8B are side views showing a clutch for driving the developing roller and the stirring roller.
Figure 8B:
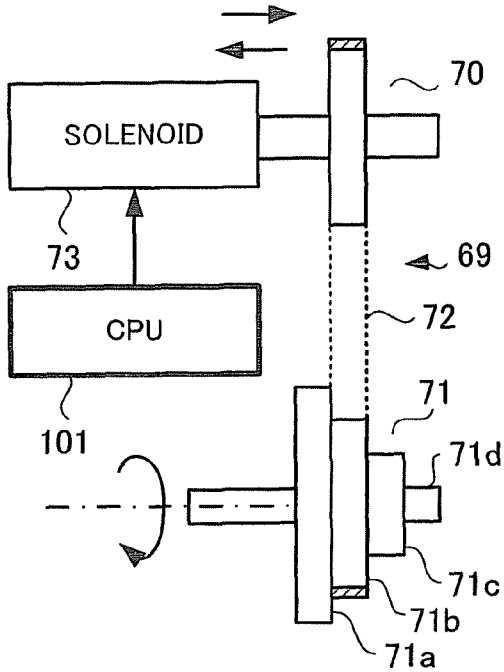

FIGS. 8A and 8B are diagrams for explanation of a configuration and an operation of the clutch 69. Since the clutch 69 is a generally known technology, its detailed configuration will be omitted but the schematic configuration will be shown.

As shown in FIG. 8A, the gear 70 moves in the right and left directions by a solenoid 73. Therefore, the gear 70 connects to one of gears of the multi-stage gear 71 via the belt 72. The solenoid 73 is controlled by the CPU 101 (corresponding to the system control section 101 in FIG. 5), and the gear 70 moves in an arbitrary position according to the mode of the image forming apparatus 100.

The multi-stage gear 71 includes four stages of gears 71*a*, 71*b*, 71*c*, 71*d*. When the gear 70 and the gear 71*a* are connected by the belt 72, for example, the rotations of the gear 66 (motor M1) and the gear 67 are transmitted to the gear 68 at the normal speed. Thereby, the developing roller 52 rotates at the normal speed via the gears 61, 62, 63. This status corresponds to the printing job mode at the normal speed in FIGS. 5A and 5B.

As shown in FIG. 8B, when the gear 70 and the gear 71*b* are connected by the belt 72, the rotation of the gear 66 (motor M1) is transmitted to the gear 68 at the ½ speed, and the developing roller 52 rotates at the ½ speed. This status corresponds to the printing job mode at the ½ speed in FIGS. 6A and 6B. Further, when the gear 70 and the gear 71*c* are connected by the belt 72, the rotation of the gear 66 (motor M1) is transmitted to the gear 68 at the ⅓ speed, and the developing roller 52 rotates at the ⅓ speed. This status corresponds to the printing job mode at the ⅓ speed in FIGS. 6A and 6B.

Furthermore, when the gear 70 and the gear 71*d* are connected by the belt 72, the gear 71*d* idly rotates, the rotation of the gear 66 (motor M1) is not transmitted to the gear 68, and the developing roller 52 stops rotating. This status corresponds to the forcible toner supply mode and the automatic toner adjustment mode in FIGS. 6A and 6B. In any mode, the gear 66 rotates at the normal speed, and the stirring rollers 54, 55 can sufficiently stir the developer.

According to the above described embodiment, even if the process speed changes, the stirring rollers 54, 55 can be rotated at a constant speed and image density irregularities in printing can be reduced.

Further, since the developing roller 52 can reduce the rotational speed according to the mode and the developing roller 52 stops in the toner concentration correction mode, flying toner can be suppressed by idle rotation. When the developing roller 52 stops, there is no need to rotate the photoconductive drum 22, and thereby, the degradation of the developer and the photoconductor can be reduced.

Not limited to the above described embodiment, various changes can be made. For example, the system using the intermediate transfer belt 21 is described, however, a system not using the intermediate transfer belt 21 may be applied.

Although exemplary embodiments are shown and described, it will be apparent to those having ordinary skill in the art that a number of changes, modifications, or alterations as described herein may be made, none of which depart from the spirit. All such changes, modifications, and alterations should therefore be seen as within the scope.

What is claimed is:

1. An image forming apparatus comprising:

an image carrier;

an exposure unit that exposes a surface of the image carrier to light and forms an electrostatic latent image;

a developing unit that includes a stirring roller stirring a developer and a developing roller moving toner to the surface of the image carrier, and develops the electrostatic latent image formed on the image carrier to form a toner image;

a drive source that rotationally drives the developing roller and the stirring roller; and a control unit that controls the drive source to change a rotational speed of the developing roller in a first mode and a second mode of an image forming, respectively, rotates the developing roller at a first speed in the first mode, rotates the developing roller at a lower speed than the first speed in the second mode, and rotationally controls the stirring roller at an equal speed in both the first mode and the second mode.

2. The apparatus of claim 1, wherein the drive source has a first motor that drives the developing roller and a second motor that drives the stirring roller.

3. The apparatus of claim 1, wherein the drive source has a first motor that drives the stirring roller and a clutch that converts and transmits rotation of the first motor into a speed according to the modes to the developing roller.

4. The apparatus of claim 1, wherein the image forming apparatus has a plurality modes which include a toner concentration correction mode.

5. The apparatus of claim 4, wherein the control unit forcibly supplies toner to the developing unit when toner concentration within the developing unit is less than preset concentration, and rotates the stirring roller at the equal speed and stops the developing roller.

6. The apparatus of claim 4, wherein the control unit automatically adjusts toner concentration within the developing unit by rotating the stirring roller at the equal speed when the power is on and stops the developing roller.

7. The apparatus of claim 1, wherein the control unit switches the rotational speed of the developing roller according to a thickness of paper to be processed in the image forming apparatus, and, when the thickness of the paper increases, rotates the developing roller in a lower speed than the first speed and rotates the stirring roller at the equal speed.

8. A developing apparatus comprising:

a developing container containing first and second spaces;

a stirring roller that stirs and moves a developer supplied to the first space of the developing container to the second space;

a developing roller that is provided facing a photoconductor and moves the developer within the second space to the photoconductor;

a drive source that rotationally drives the developing roller and the stirring roller; and a control unit that controls the drive source to change a rotational speed of the developing roller in a first mode and a second mode, respectively, rotates the developing roller at a first speed in the first mode, rotates the developing roller at a lower speed than the first speed in the second mode, and rotationally controls the stirring roller at an equal speed in both the first mode and the second mode.

9. The apparatus of claim 8, wherein the drive source has a first motor that drives the developing roller and a second motor that drives the stirring roller.

10. The apparatus of claim 8, wherein the drive source has a first motor that drives the stirring roller and a clutch that converts and transmits rotation of the first motor into a speed according to the modes to the developing roller.

11. The apparatus of claim 8, wherein the control unit switches the rotational speed of the developing roller according to a thickness of paper to be processed, and, when the thickness of the paper increases, rotates the developing roller in a lower speed than the first speed and rotates the stirring roller at the equal speed.

12. The apparatus of claim 8, wherein the control unit forcibly supplies toner to the developing container when toner concentration within the developing container is less than preset concentration, and rotates the stirring roller at the equal speed and stops the developing roller.

13. The apparatus of claim 8, wherein the control unit automatically adjusts toner concentration within the developing container by rotating the stirring roller at the equal speed when the power is on and stops the developing roller.

14. A supplying method of toner in a developing apparatus, comprising:

including a developing container containing first and second spaces;

stirring and moving a developer supplied to the first space of the developing container to the second space with a stirring roller;

moving the developer within the second space to a photoconductor with a developing roller;

independently and rotationally controlling the developing roller and the stirring roller;

changing a rotational speed of the developing roller in a first mode and a second mode, respectively, rotates the developing roller at a first speed in the first mode, rotates the developing roller at a lower speed than the first speed in the second mode, and rotating the stirring roller at an equal speed in both the first mode and the second mode.

15. The method of claim 14, wherein the developing roller is driven by a first motor and the stirring roller is driven by a second motor.

16. The method of claim 14, wherein the stirring roller is driven by a first motor and rotation of the first motor is converted into a speed according to the modes and transmitted to the developing roller.

17. The method of claim 14, wherein the developing apparatus has a plurality modes which includes a toner concentration correction mode.

18. The method of claim 17, wherein toner concentration within the developing container is detected and toner is forcibly supplied to the developing container when the toner concentration within the developing container is less than preset concentration, and the stirring roller is rotated at the equal speed and the developing roller is stopped in the forcible toner supply mode.

19. The method of claim 17, wherein toner concentration within the developing container is automatically adjusted by rotating the stirring roller at the equal speed when the power of the developing apparatus is on, and the developing roller is stopped in the automatic adjustment mode.

20. The method of claim 14, wherein the rotational speed of the developing roller is switched according to a thickness of paper to be processed, and, when the thickness of the paper increases, the developing roller is rotated in a lower speed than the first speed, and the stirring roller is rotated at the equal speed regardless of the thickness of the paper.

* * * * *